US006390900B1

(12) United States Patent
Susnjara

(10) Patent No.: US 6,390,900 B1
(45) Date of Patent: May 21, 2002

(54) FINISHING TOOL FOR CNC ROUTER MACHINES

(75) Inventor: Kenneth J. Susnjara, Birdseye, IN (US)

(73) Assignee: Thermwood Corporation, Dale, IN (US)

( * ) Notice: Subject to any disclaimer, the term of this patent is extended or adjusted under 35 U.S.C. 154(b) by 11 days.

(21) Appl. No.: 09/136,761

(22) Filed: Aug. 19, 1998

(51) Int. Cl.[7] ..... B24B 7/00

(52) U.S. Cl. ..... 451/178; 451/362; 451/231; 451/44; 451/541; 451/547

(58) Field of Search ..... 451/362, 231, 451/44, 541, 547

(56) References Cited

U.S. PATENT DOCUMENTS 3,711,999 A * 1/1973 Held ..... 451/73
4,461,121 A * 6/1984 Motzer et al. ..... 451/5
4,833,764 A * 5/1989 Muller ..... 451/5
5,220,749 A * 6/1993 Youden et al. ..... 451/65

* cited by examiner

*Primary Examiner*—Joseph J. Hail, III
*Assistant Examiner*—Shantese McDonald
(74) *Attorney, Agent, or Firm*—Lalos & Keegan

(57) ABSTRACT

A tool mountable on a high speed spindle of a CNC machine tool, operable to finish a side edge of a flat workpiece positioned directly on a support surface of the machine tool, generally consisting of a member having a shank portion removeably mountable on the spindle of the toolhead assembly of the machine, and a head section. The head section is provided with an annular side surface engageable with the side edge of a flat workpiece positioned directly on the support surface of the table of the machine. The annular surface also is provided with a profile corresponding to the profile of the side edge of the workpiece being finished, and abrasive particles bonded thereto.

9 Claims, 3 Drawing Sheets

FINISHING TOOL FOR CNC ROUTER MACHINES

This invention relates to tool for CNC machine tools and more particularly to such a tool for finishing the side edges of flat workpieces supported on tables of CNC router machines.

BACKGROUND OF THE INVENTION

In the prior art, there has been developed a CNC machine of the type shown in FIG. 1 which may by utilized to perform various machining operations on a workpiece supported thereon. Generally, the machine includes a base member 10, a table 11 supported on a set of guideways provided on the base member and displaceable longitudinally or along an x-axis, a bridge or gantry member 12, disposed transversely and above table 10, and supported on a pair of upright members 13 and 14 disposed astride the base member and usually connected thereto, a toolhead support assembly 15 supported on the bridge member and displaceable transversely or along a y-axis on set of guideways 16 and 17, and a toolhead assembly 18 supported on the toolhead support assembly and displaceable vertically along a z-axis. Worktable 11 is provided with a workpiece support surface 19 on which a flat workpiece or panel 20 may be mounted to be machined. The workpiece may be held on the worktable by means of either mechanical clamps or a vacuum system. In lieu of worktable 11 being displaceable along the x-axis and gantry 12 being stationary as shown in FIG. 1, work table 11 may be stationary and gantry 12 may be mounted on guideways provided on base member 10 and displaceable along the x-axis.

Toolhead assembly 18 is of a rotary turret type which may be indexed to position eight different powered tools 21 vertically or along the z-axis to perform various machining functions. The construction and operation of a machine as shown in FIG. 1 is described in greater detail in U.S. patent application, Ser. No. 08/701,315, filed Aug. 21, 1996, which is incorporated herein by reference. In lieu of a turret type of toolhead assembly, a conventional tool changer can be used which operates simply to position and attach selected tools to a single spindle of the toolhead assembly.

Typically, the various tools mountable on the rotary turret of the machine shown in FIG. 1 include a router, a shaper, a drill unit, an electric saw, a comer squaring tool and a profile edge sanding system. Such tools are usually driven by electric and air motors at speeds of up to 18,000 rpm. The machine further has a feed rate of up to 900 inches per minute although the actual feed rate will depend on the particular tool used, the material being machined, the pattern being cut and the finish desired.

In the use of the machine as described in forming an edge on a workpiece 20 which may consist of the top of a table, desk, bureau or other item of furniture, with the controller of the machine programmed and operating, the rotary turret will index to position a router tool of the desired profile into the vertical, operative position, and the servomotors operating the displacements of the table, tool head support assembly and toolhead assembly will be operated in accordance with the instructions of the program inputted into the controller of the machine to rout the edges of the workpiece supported on the table. When the routing operation has been completed, the rotary turret is indexed again to position the edge-sanding tool in the operative position to traverse the same path as the router tool to provide a sanded finish. In the past, such sanding tool has consisted of a lower, circular plate member, an upper circular plate member provided with a shank section mountable on the toolhead spindle and a sanding strip interposed between the upper and lower plate members and about the periphery thereof. Because of the configuration of such edge-sanding tools, it has been necessary to interrupt the machining sequence of such workpieces to elevate the workpieces relative to the table on which they are supported in order to permit such edge-sanding tools to be used without the lower plate members thereof engaging the worktable. Furthermore, because of the nature of the construction of such edge-sanding tools, they are required to be operated at much lower speeds, usually in the order of 1,800 rpm which require different motors than the other tools mounted on the rotary turret which normally operate at much higher speeds. Typically, such edge-sanding tools require 2 hp motors as compared to 9 hp motors for the other cutting tools of the turret.

The necessity of having to interrupt an edge forming and finishing operation to elevate the workpiece after the routing stage of the operation, the requirement of a motor different than the motors of the other tools mounted on the rotary turret and the low operating speeds of such conventional edge-sanding tools has had the effect of not only increasing the cost of manufacture of such machines but reducing their productivity. It thus has been found to be desirable to provide an edge finishing tool for the type of machine described which would obviate such problems attendant to prior art edge finishing tools.

SUMMARY OF THE INVENTION

The present invention obviates the aforementioned shortcomings of conventional edge finishing tools by providing a tool mountable on a high speed spindle of a CNC machine tool, operable to finish a side edge of a flat workpiece positioned on a support surface of the machine tool, generally consisting of a member having a shank section removeably mountable on the spindle of the toolhead assembly of the machine, and a head section. The head section is provided with an annular side surface engageable with the side edge of the workpiece positioned directly on the support surface of the machine. The annular surface is provided with a profile corresponding to the profile of the side edge of the workpiece, and abrasive particles bonded to such surface.

DESCRIPTION OF THE PREFERRED EMBODIMENT OF THE INVENTION

Figure 1:
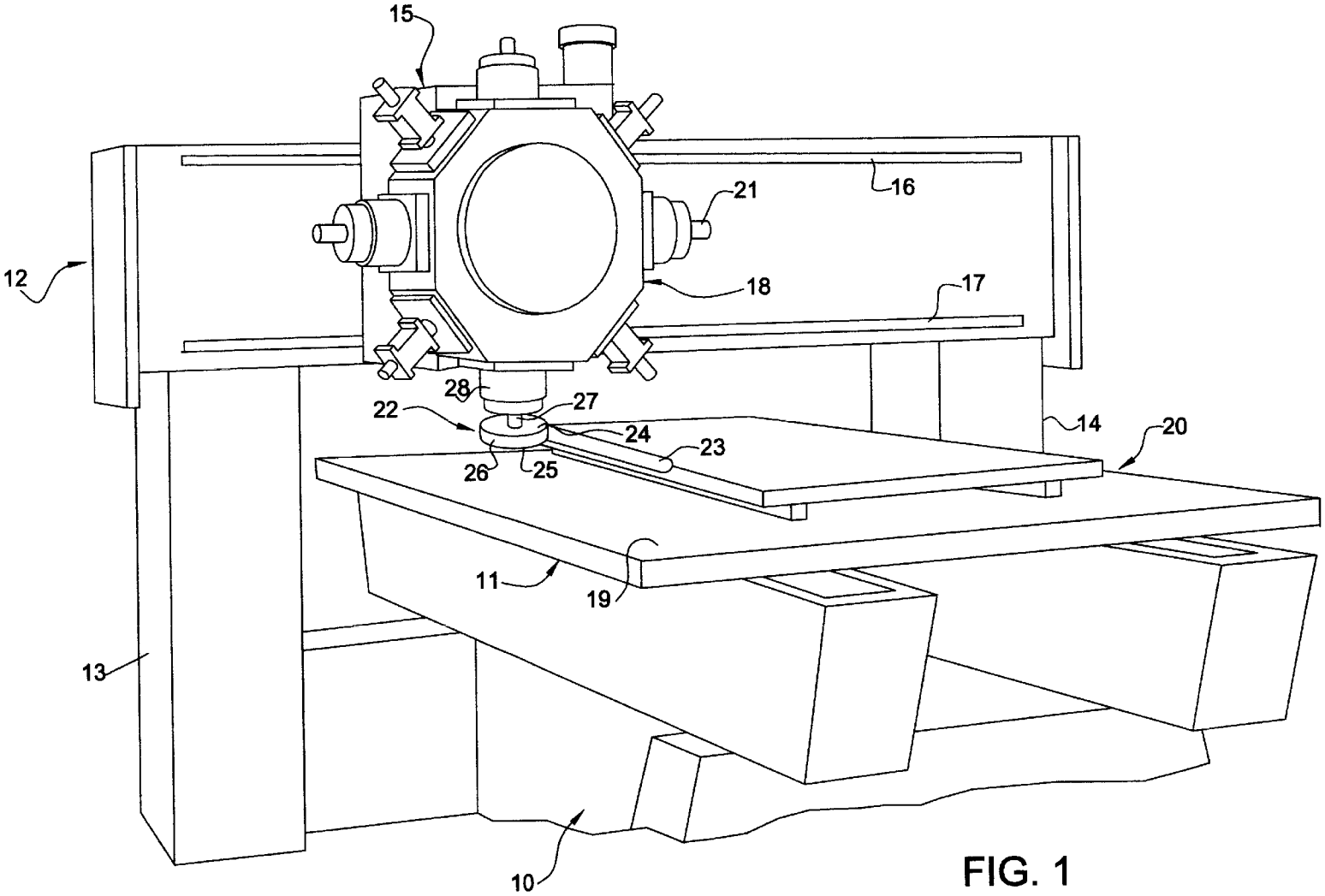
FIG. 1 is a perspective view of a CNC router machine having a flat workpiece mounted on the table thereof in an elevated position, and utilizing a prior art edge-sanding tool.
Figure 2:
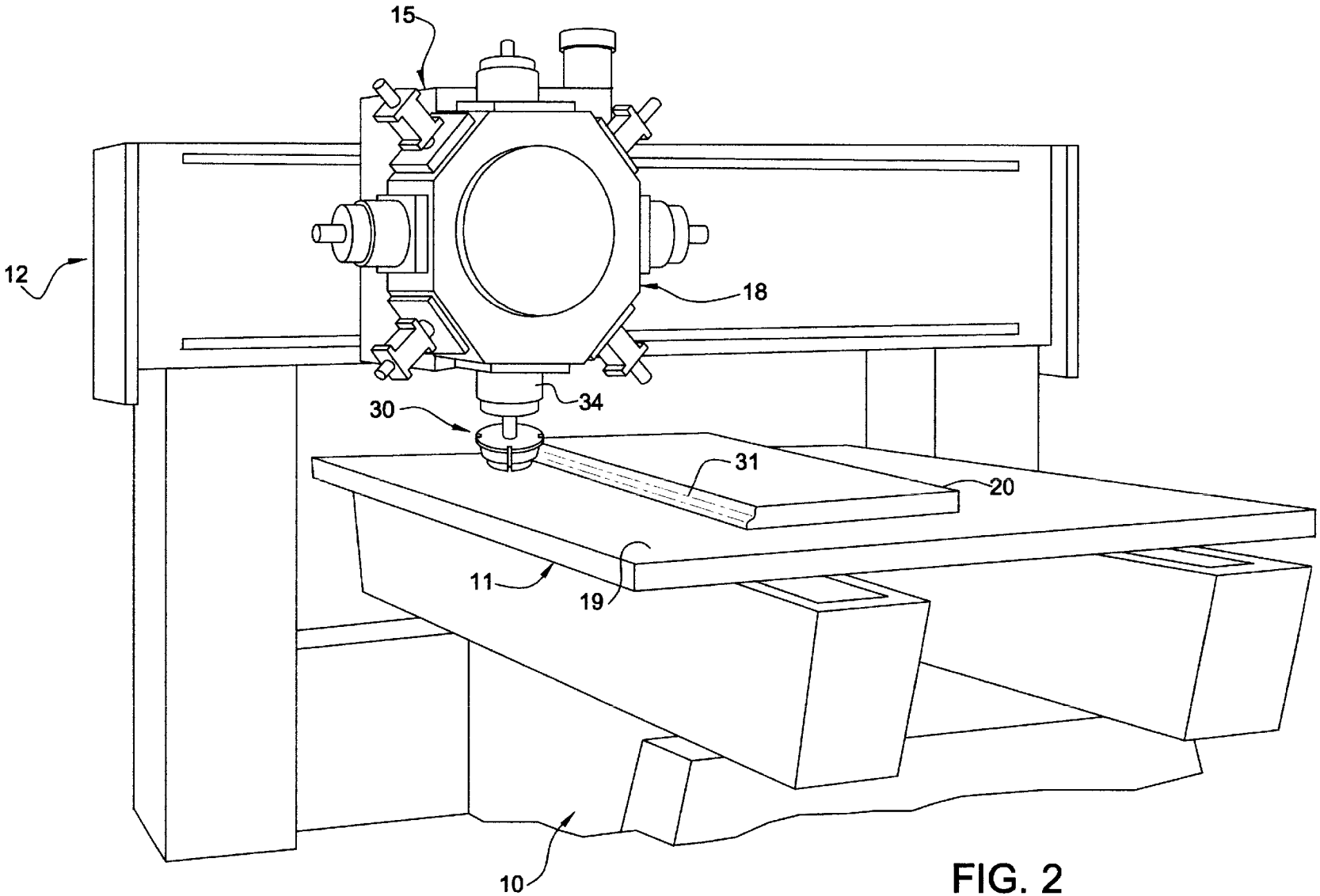
FIG. 2 is a perspective view of the machine illustrated in FIG. 1, having a flat workpiece mounted directly on the support surface of the table thereof, and utilizing an edge-sanding tool embodying the present invention.
Figure 3:
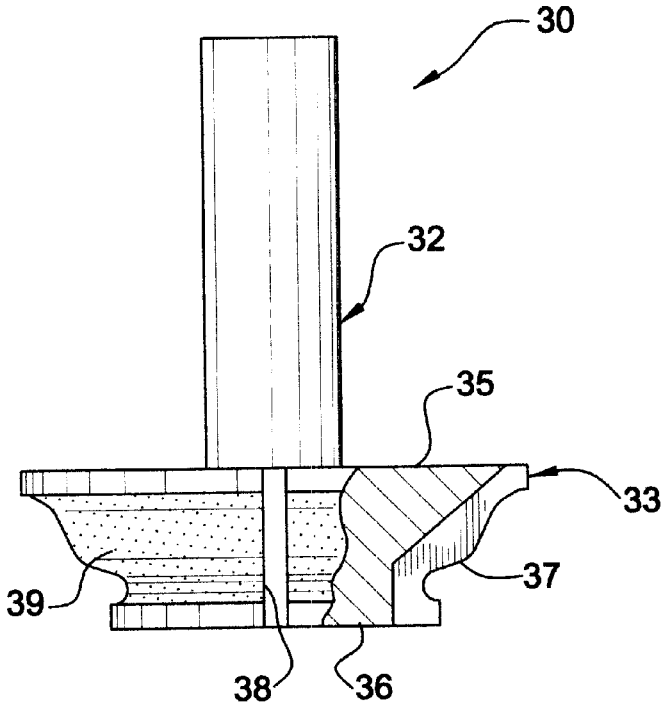
FIG. 3 is an enlarged, elevational view of the edge finishing tool shown in FIG. 2, having a portion thereof broken away.
Figure 4:
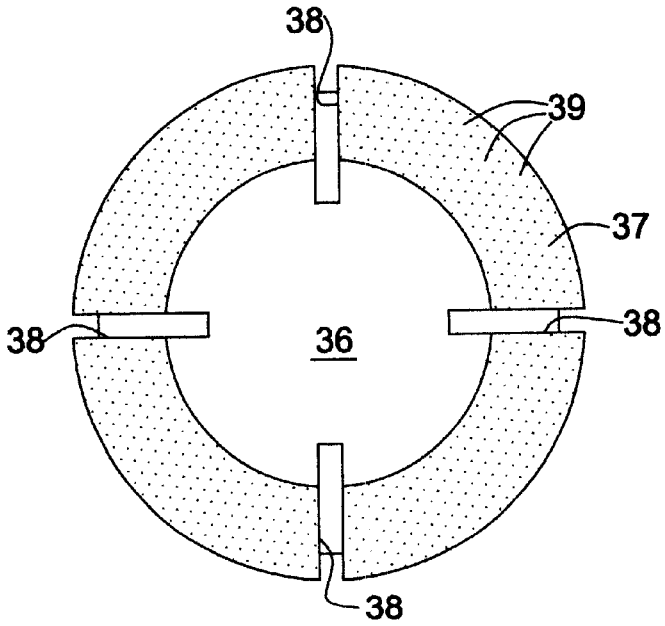
FIG. 4 is a bottom plan view of the tool shown in FIG. 3.

The machine shown in FIG. 1 illustrates workpiece 20 being elevated from support surface 19 of table 11 in order to accommodate edge-sanding tool 22 used to sand previously routed side edge 23 of the workpiece. The tool consists of an upper circular plate member 24, a lower circular plate 25, a sanding strip 26 interposed between the plate members about the periphery thereof and a shank member 27 removeably secured to the spindle of a 2 hp motor 28 mounted at one of the stations of rotary turret 18. Workpiece 20 must be elevated from the upper surface of the table as shown in order to prevent lower plate 25 of the tool engaging support surface 19 of the table. FIG. 2 illustrates an edge finishing tool 30 removeably mountable on rotary turret 18, embodying the present invention, which is capable of machining workpiece 20 mounted directly on support surface 19 of table 11 to sand or otherwise finish a routed side edge surface 31 of workpiece 20. As best shown in FIGS. 3 and 4, tool 30 consists of a member having a shank section 32 and a head section 33. The shank section is removeably mountable on the spindle of a 9 hp motor 34 capable of operating at speeds of up to 18,000 rpm. Head section 33 includes an upper planar surface 35, a bottom planar surface 36 disposed substantially parallel to upper surface 35 and an annular side surface 37 having a profile corresponding to the profile of the router tool used to form side edge surface 31 of workpiece 20. Annular side surface 37 is disposed coaxially with shank section 32 and further includes a plurality of circumferentially spaced flutes 38 to facilitate material removal as the tool rotates at high speeds. Annular surface 37 further is provided with a coating of abrasive particles 39 bonded thereto by a suitable adhesive or embedded in the material of the head section. The member is of a one-piece construction and preferably consists of carbide steel. The abrasive particles preferably consist of a synthetic diamond material with a grit size of 150.

With a tool as shown in FIGS. 3 and 4 for finishing the side edge of a workpiece supported on the table of the machine as shown in FIGS. 1 and 2, the workpiece need not be elevated as shown in FIG. 1 in that the configuration of the tool permits its positioning adjacent the support surface of the table without interference in its operation. Because of its sturdy construction, it may be provided with a larger, 9 hp motor and can be operated at speeds of up to 18,000 rpm and typically at a speed of 8,000 rpm, far faster than the operating speed of finishing tool 22 in the order of 1,800 rpm, and further may be operated at a feed rate of 300 inches per minute. The sturdy construction further provides a finer finish with greater tool longevity. By not having to interrupt the operating cycle of the machine to reposition the workpiece, the productivity of the machine is correspondingly enhanced. In addition, because of the construction and configuration of tool 30, the head section thereof can made of smaller diameters than tool 22 thus permitting the sanding or other finishing of corners of small radii.

It will be appreciated that with the type of tool shown in FIGS. 3 through 4 in lieu of the prior art type of tool shown in FIG. 1, manufacturing costs are reduced, productivity is increased and the longevity of the finishing tool is enhanced.

From the foregoing detailed description, it will be evident that there are a number of changes, adaptations, and modifications of the present invention which come within the province of those persons having ordinary skill in the art to which the aforementioned invention pertains. However, it is intended that all such variations not departing form the spirit of the invention be considered was within the scope thereof as limited solely by the appended claims.

I claim:

1. A tool mountable on a high speed spindle of a CNC machine tool, operable to finish a side edge of a flat workpiece positioned directly on a support surface of said machine tool, comprising a member having a shank section removeably mountable on said spindle and a head section, said head section having an annular side surface engageable with the side edge of a flat workpiece positioned directly on said support surface and having a bottom surface lying in a plane disposed perpendicular to an axis of said shank section, and said annular surface having a profile corresponding to the profile of said side edge and abrasive particles bonded thereto.

2. A tool according to claim 1 wherein said bottom surface is disposed immediately adjacent said annular side surface, permitting said bottom surface to be positioned just clear of said support surface when said annular side surface operatively engages said side edge of a flat workpiece disposed on said support surface.

3. A tool according to claim 1 wherein said annular side surface is provided with a plurality of circumferentially spaced flutes.

4. A tool according to claim 3 wherein said flutes lie in planes passing through an axis of said shank section.

5. A tool according to claim 1 wherein said abrasive particles have a grit size of 150.

6. A tool according to claim 1 wherein said abrasive particles consist of diamond grit.

7. A tool according to claim 6 wherein said abrasive particles have a grit size of 150.

8. A tool according to claim 1 wherein said member is formed of carbide steel and said particles are formed of a synthetic diamond material having a grit size of 150.

9. A tool mountable on a high speed spindle of a CNC machine tool, operable to finish a side edge of a flat workpiece positioned directly on a support surface of said machine tool, comprising a carbide steel member having a shank section removeably mountable on said spindle and a head section, said head section having an annular side surface engageable with the side edge of a flat workpiece positioned directly on said support surface, and said annular surface having a profile corresponding to the profile of said side edge and abrasive particles bonded thereto.

* * * * *